US011939775B2

(12) United States Patent
Giacometti et al.

(10) Patent No.: US 11,939,775 B2
(45) Date of Patent: Mar. 26, 2024

(54) ARRANGEMENT FOR SECURING A PANEL IN A RAIL BY TIGHTENING OUTER WEDGES FROM AN INNER SIDE OF THE PANEL

(71) Applicant: SB INGENIERIE, Poisy (FR)

(72) Inventors: Sylviane Giacometti, Poisy (FR); Romain Chapel, Saint-Silvestre (FR); Léandre Rouif, Annecy (FR)

(73) Assignee: SB INGENIERIE, Poisy (FR)

( * ) Notice: Subject to any disclaimer, the term of this patent is extended or adjusted under 35 U.S.C. 154(b) by 416 days.

(21) Appl. No.: 17/604,633

(22) PCT Filed: May 25, 2020

(86) PCT No.: PCT/EP2020/064396

§ 371 (c)(1),
(2) Date: Oct. 18, 2021

(87) PCT Pub. No.: WO2020/239670

PCT Pub. Date: Dec. 3, 2020

(65) Prior Publication Data

US 2022/0195734 A1 Jun. 23, 2022

(30) Foreign Application Priority Data

May 31, 2019 (FR) ..... 1905808

(51) Int. Cl.
*E04F 11/18* (2006.01)

(52) U.S. Cl.
CPC ..... *E04F 11/1812* (2013.01); *E04F 11/1853* (2013.01); *E04F 2011/1895* (2013.01)

(58) Field of Classification Search
CPC ..... E04F 11/1812; E04F 11/1817; E04F 11/1851; E04F 11/1853; E04F 2011/1823;
(Continued)

(56) References Cited

U.S. PATENT DOCUMENTS 4,680,903 A * 7/1987 Horgan, Jr. ..... E06B 3/5409 52/766
7,730,682 B2 * 6/2010 Nash ..... E06B 3/5454 52/800.18

(Continued)

FOREIGN PATENT DOCUMENTS

DE 10 2016 112775 B3 10/2017
EP 2 921 607 A2 9/2015
EP 3 323 958 A1 5/2018

OTHER PUBLICATIONS

International Search Report and Written Opinion dated Aug. 6, 2020, issued in corresponding International Application No. PCT/EP2020/064396, 9 pages.

(Continued)

*Primary Examiner* — Jonathan P Masinick
(74) *Attorney, Agent, or Firm* — Christensen O'Connor Johnson Kindness PLLC

(57) ABSTRACT

The invention relates to an arrangement for securing a vertical panel (14) in a longitudinal groove (28), the panel (14) comprising an inner face (20) and an outer face (22), the securing being carried out by transverse clamping between transversely opposed wedges (36A, 36B; 38A, 38B), the arrangement comprising: an upper outer wedge (38A) and a lower outer wedge (38B) which are each positioned between an outer face (34) of the groove (28) and the outer vertical face (22) of the panel (14); at least two movable transmission members (62A, 62B) which are each capable of transmitting a sliding force to an associated outer wedge (38A, 38B), the force being applied from an inner side (24) of the panel (14); the arrangement is characterized in that the upper and lower outer wedges (38A, 38B) slide vertically upwards from the released position thereof to the clamped position thereof above the released position.

16 Claims, 12 Drawing Sheets

(58) Field of Classification Search
CPC ... E04F 2011/1895; E06B 3/54; E06B 3/5454
See application file for complete search history.

(56) References Cited

U.S. PATENT DOCUMENTS

| | | | | |
|---|---|---|---|---|
| 8,181,405 | B2 * | 5/2012 | Nash | E04F 11/1851 52/800.18 |
| 9,617,736 | B2 * | 4/2017 | Zhou | E04F 11/1812 |
| 9,657,760 | B2 * | 5/2017 | Giacometti | F16B 5/0685 |
| 10,640,985 | B2 * | 5/2020 | Strehlow | E04F 11/1817 |
| 10,718,117 | B2 * | 7/2020 | Noble | E04F 11/1834 |
| 10,830,264 | B2 * | 11/2020 | Dagand | F16B 2/14 |
| 10,876,297 | B1 * | 12/2020 | Poma | E04F 11/1812 |
| 11,053,688 | B2 * | 7/2021 | Ravan | E04F 11/1853 |
| 11,156,000 | B2 * | 10/2021 | Noble | E04F 11/1851 |
| 11,187,323 | B2 * | 11/2021 | Sprague | F16J 15/0818 |
| 2013/0248792 | A1 * | 9/2013 | Bangratz | E04F 11/1851 256/24 |
| 2015/0110552 | A1 * | 4/2015 | Yang | E04F 11/1812 403/374.1 |
| 2015/0240851 | A1 | 8/2015 | Giacometti et al. | |
| 2016/0298375 | A1 * | 10/2016 | Wagner | E04F 11/1853 |
| 2017/0101784 | A1 * | 4/2017 | Gonzato | E04F 11/1812 |
| 2018/0135669 | A1 | 5/2018 | Dagand et al. | |
| 2019/0177973 | A1 * | 6/2019 | Mitrovic | E04H 4/14 |
| 2019/0249442 | A1 | 8/2019 | Strehlow et al. | |
| 2022/0195734 | A1 * | 6/2022 | Giacometti | E04F 11/1853 |

OTHER PUBLICATIONS

International Search Report dated Oct. 2, 2020, issued in corresponding International Application No. PCT/EP2020/064396, filed May 25, 2020, 2 pages.

Written Opinion of the International Searching Authority dated Oct. 2, 2020, issued in corresponding International Application No. PCT/EP2020/064396, filed May 25, 2020, 6 pages.

International Preliminary Report on Patentability dated Nov. 16, 2021, issued in corresponding International Application No. PCT/EP2020/064396, filed May 25, 2020, 1 page.

* cited by examiner

ARRANGEMENT FOR SECURING A PANEL IN A RAIL BY TIGHTENING OUTER WEDGES FROM AN INNER SIDE OF THE PANEL

TECHNICAL FIELD OF THE INVENTION

The invention relates to the field of devices for securing panels, in particular glass panels, in a rail by tightening wedges located on both sides of the panel in a groove of the rail.

TECHNICAL BACKGROUND

It is known that guardrails can be made by securing a vertical panel in the groove of a rail. Such a panel is made of glass, for example.

Classically, the positioning and securing of a guardrail panel in the groove is achieved by inserting at least two opposing wedges on either side of the panel. In order to be able to adjust the verticality of the panel at the same time as its securing, the tightening of each wedge is adjusted by means of an associated screw-nut assembly. The wedge is thus tightened either by moving the screw or by moving the nut as the screw is screwed.

Each screw-nut assembly is arranged on the same side of the panel as the wedge whose tightening it controls. Thus, when mounting the guardrail, an operator first installs the panel in the groove. The operator then accesses a first side of the panel to adjust the tightness of the first wedge. The operator then accesses the other side of the panel to adjust the tightening of the second opposite wedge.

An example of such an arrangement for securing a panel is disclosed for example in EP A2 2.921.607.

Such an arrangement provides a very strong securing of the panel in the groove while allowing easy adjustment of the verticality of the panel.

However, in some cases, the panel is only easily accessible from one side, the so-called inner side. This is particularly the case when the guardrail is arranged at a high level, where the outer side faces the void. As a result, it is not possible to screw the wedge on the other outer side without using a lifting means such as a scaffold or a platform.

To solve this problem, securing arrangements with wedges only on the inner side have already been proposed.

However, such an arrangement does not allow easy adjustment of the verticality of the panel during the securing operation.

It has also been proposed to pull the wedge on the outer side from the inner side of the panel by means of a flexible strip.

However, this solution is complex and expensive to implement. The flexible strip must be able to withstand a very high tension. Therefore, the strip must be made of a material that is both flexible and highly tensile strength. In addition, the strip applies a very high pressure on the panel cradle.

SUMMARY OF THE INVENTION

The invention provides an arrangement for securing a vertical panel in a longitudinal groove opened vertically upwards for receiving a lower edge of the panel, the panel having an inner face and an outer face, the securing being carried out by transverse tightening between transversely opposed wedges, the arrangement comprising:

at least one first upper outer wedge and at least one second lower outer wedge which are each sandwiched between a vertical outer face of the groove and the vertical outer face of the panel, each of the outer wedges being mounted so as to slide vertically in the groove between a released position and a tight position between the outer face of the groove and the outer face of the panel;

at least two movable transmission members which are interposed between the edge of the panel and a bottom of the groove and which are each adapted to transmit a sliding force to an associated outer wedge applied from an inner side of the panel.

The arrangement is characterized in that the upper and lower outer wedges slide vertically upwards from their one released position to their tight position located above the released position.

According to further features of the invention:

in order to control the outer wedges to their tight position, all movable transmission members are biased in compression by at least one control device which is arranged on the inner side of the panel;

each movable transmission member is formed by at least one rigid element in the form of a semi-circular segment which is slidably received in a channel of complementary shape arranged between the edge of the panel and the bottom of the groove;

the transmission members are mounted parallel to each other;

the channel is formed in a cradle which straddles the edge of the panel and which is interposed between the panel and the bottom of the groove;

each outer wedge is interposed between an outer flange of the cradle and the outer face of the panel;

at least one of the outer wedges moves transversely towards the panel as it slides to its tight position, said outer wedge having a tightening face which is turned towards the outer face of the panel;

at least one of the outer wedges moves only vertically when sliding into its tight position, at least one transversely sliding mounted tightening pad being interposed between at least one of the outer wedges and the outer face of the panel, the tightening pad comprising a tightening face facing the outer face of the panel;

a shim is interposed between the outer face of the panel and the tightening face.

the arrangement comprises two separate control devices for independently controlling the sliding of the upper outer wedge and the lower outer wedge;

each control device comprises at least one screw which is capable of biasing each transmission member, the control screw being screwed into a nut which is mounted in a fixed manner with respect to the cradle in order to allow the axial displacement of the control screw relative to the cradle by screwing or unscrewing, each control device controlling the tightening of each of the upper and lower outer wedges independently of each other;

the arrangement comprises a control device common to the two upper and lower outer wedges to allow their simultaneous tightening;

the control device comprises at least one control screw which is screwed into a nut which is vertically slidably mounted in the cradle, the downward sliding of the control screw biasing the transmission member associated with one of the outer wedges towards its tight position, while the upward sliding of the nut biases the transmission member associated with the other of the outer wedges towards its tight position by means of force return means, the tightening of the outer wedges thus being achieved simultaneously by screwing the control screw into the nut;

the force return means are formed by at least one cam slidingly integral with the nut and by at least one pusher guided in displacement along an arcuate trajectory in the cradle, the cam being capable of moving a cam follower of the pusher away from the axis of the control screw by causing a lower end of the pusher to slide downwards in order to push the associated transmission member;

the control device comprises two cams and two pushers arranged symmetrically with respect to the axis of the control screw.

BRIEF DESCRIPTION OF THE FIGURES

Further features and advantages of the invention will become apparent from the following detailed description, for the understanding of which reference is made to the attached drawings in which.

DETAILED DESCRIPTION OF THE INVENTION

In the following description, the longitudinal, vertical and transverse orientations indicated by the "L,V,T" trihedron in the figures will be adopted as non-limiting.

In the following description, elements having an identical structure or similar functions will be designated by the same reference.

Figure 1:
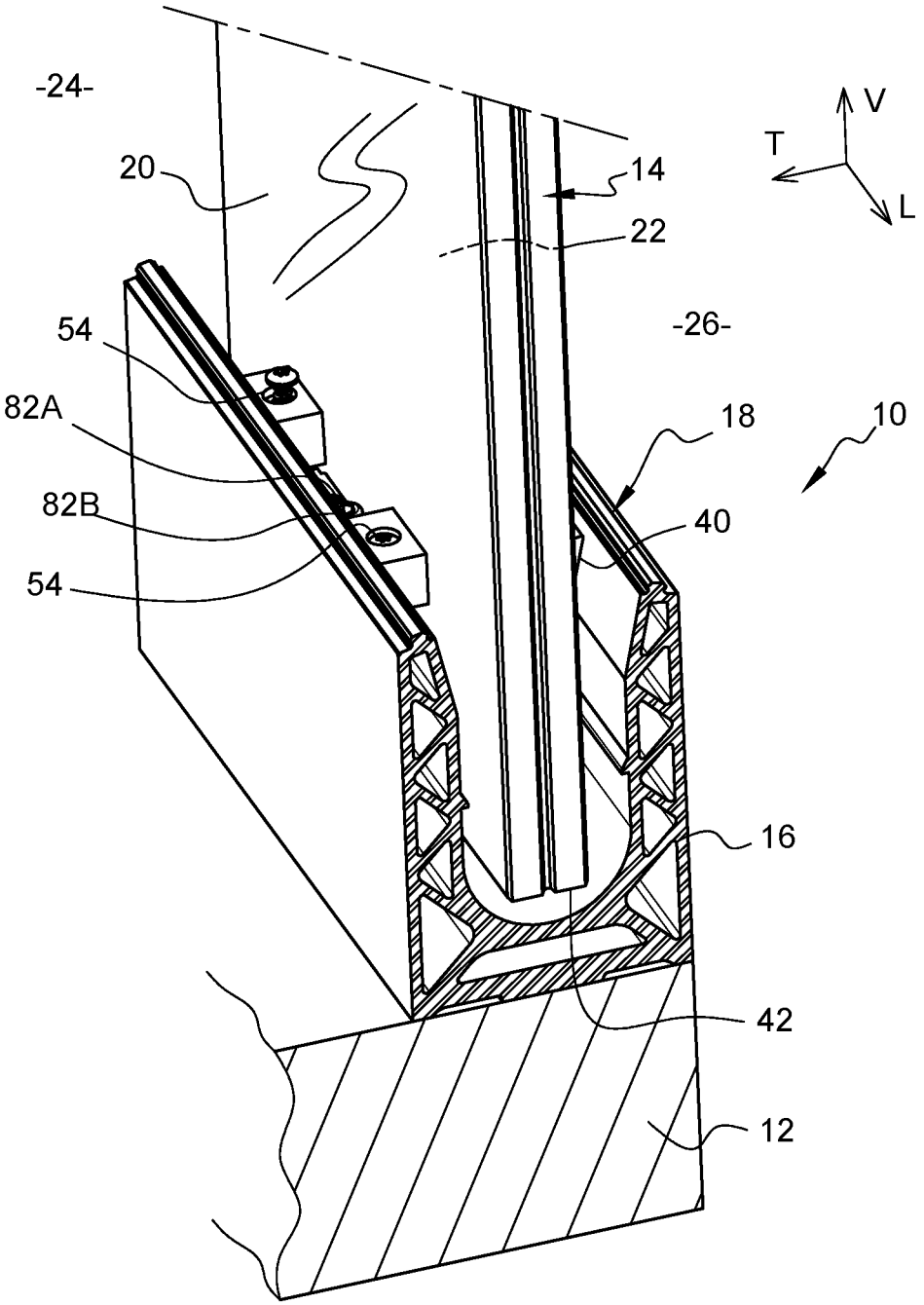
FIG. 1 is a perspective view showing a panel secured in a rail mounted on the border of a concrete slab, the panel being secured by means of a securing device made according to a first embodiment of the invention.

FIG. 1 shows a guardrail 10 which is mounted at the border of a slab 12, for example a concrete slab. The border of the slab 12 is here not easily accessible, for example it is arranged at a high level.

The guardrail 10 comprises a vertical panel 14 and a support rail 16. The panel 14 is preferably made of glass. It is held vertically in the support rail 16 by several securing devices 18 which are distributed along the length of the rail 16. Only a section of rail 16 with a single securing device 18 is shown in FIG. 1. Each securing device 18 is designed to allow the panel 14 to be firmly secured in a vertical position and to withstand very high loads.

The panel 14 is bounded transversely by an inner face 20 which faces the accessible side of the rail 16, and by an outer face 22 which faces the inaccessible side of the rail 16. The panel 14 in the mounted position thus divides the space into an accessible inner side 24 and an inaccessible outer side 26. For the remainder of the description, elements located on the inner side of the panel 14 will be referred to as "inner", while elements located on the outer side will be referred to as "outer".

Figure 2:
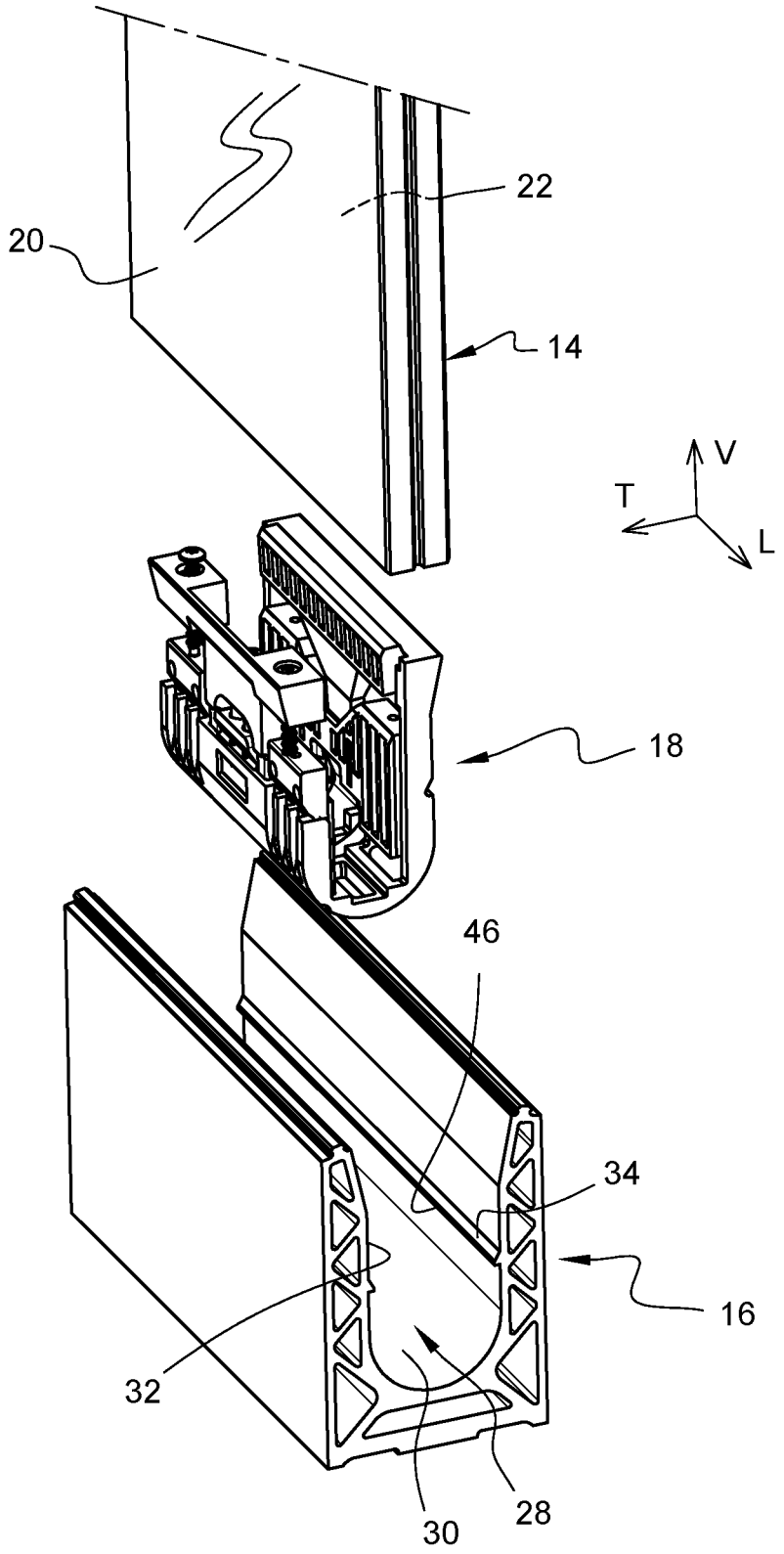
FIG. 2 is an exploded perspective view showing the rail, the securing device and the panel of FIG. 1.
Figure 3:
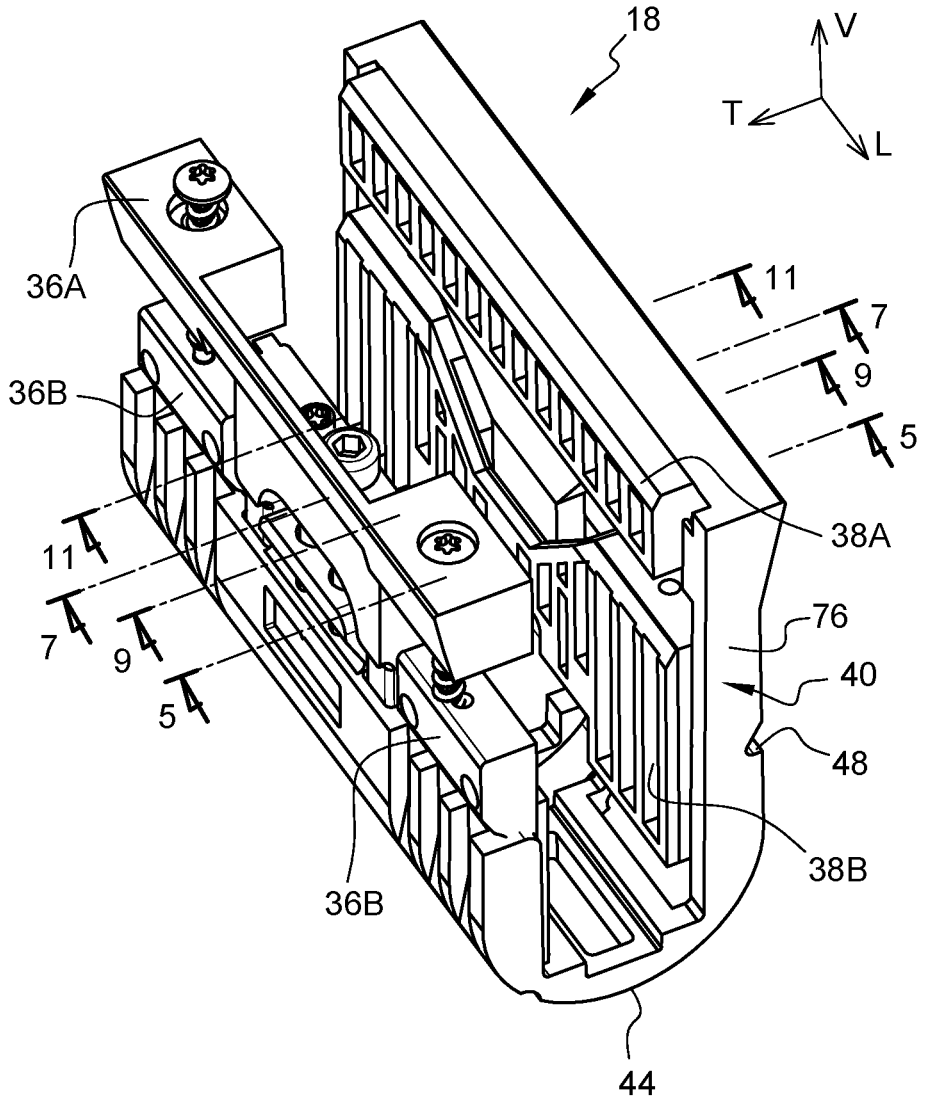
FIG. 3 is a perspective view showing the securing device of FIG. 1 alone.
Figure 4:
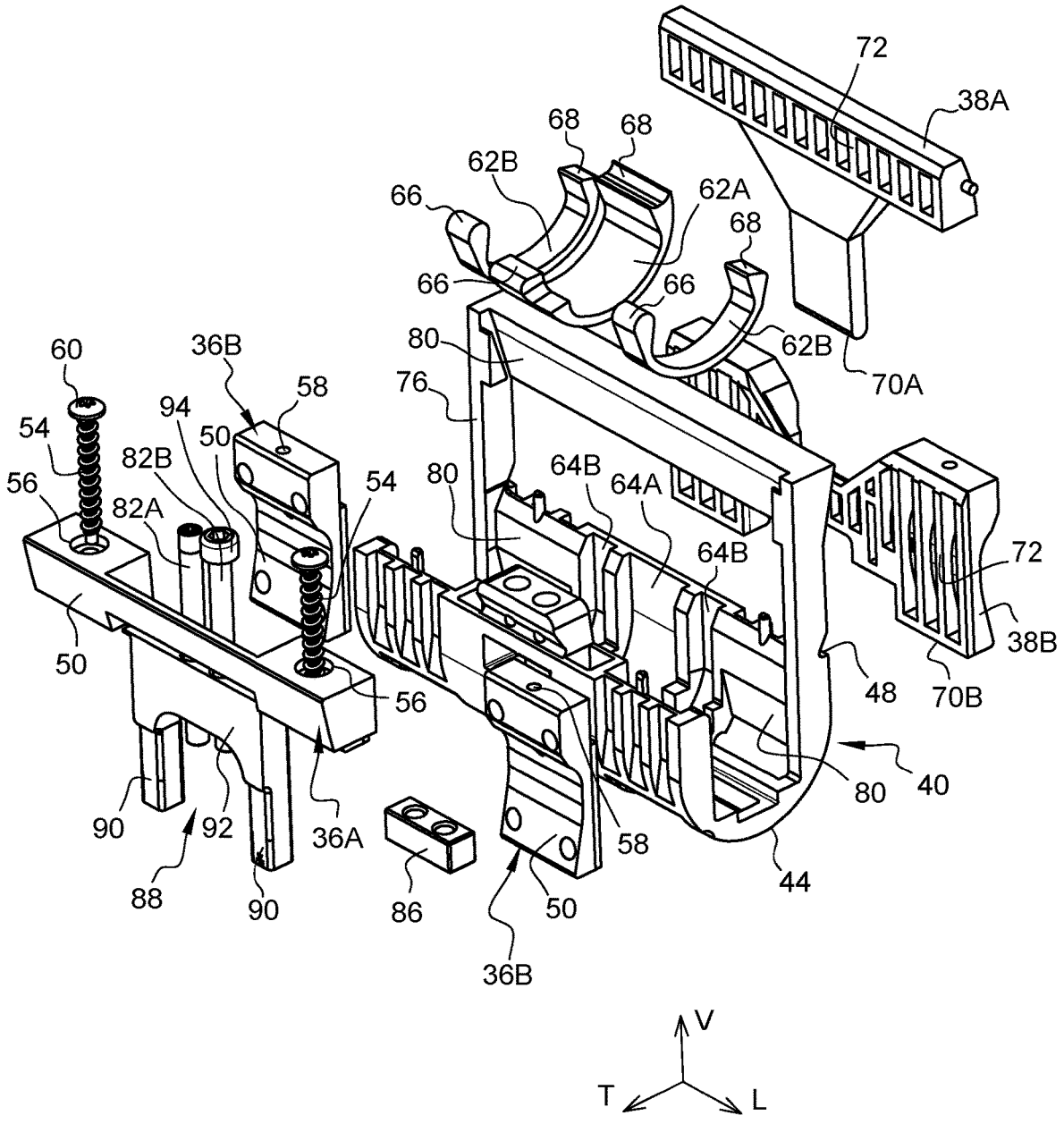
FIG. 4 is an exploded perspective view showing the components of the securing device of FIG. 3.

As illustrated in more detail in FIG. 2, the support rail 16 is formed, for example, by an aluminium profile, here having a "U"-shaped cross-section delimiting a groove 28 for receiving the panel 14 and the securing device 18. The support rail 16 extends continuously in the longitudinal direction. The support rail 16 is intended to be secured to the slab 12 before the panel 14 is mounted.

In profile view, the groove 28 has a concave, preferably semicircular, curved bottom 30 which is extended vertically upwards by an inner lateral face 32, on the one hand, and by an outer lateral face 34, on the other hand, which are arranged transversely opposite each other. The groove 28 has an upper opening. The width of the groove 28 between the two lateral faces 32, 34 is greater than the thickness of the panel 14. The first inner lateral face 32 is located on the inner side 24, while the second outer lateral face 34 is located on the outer side 26.

Each securing device 18 is designed as a module formed of several parts, some of which may be pre-assembled before insertion into the groove 28. A securing device 18 is now described with reference to FIGS. 3 and 4 and FIGS. 15 and 16.

The securing device 18 comprises at least one inner wedge 36A, 36B and at least two opposing outer wedges 38A, 38B which are intended to transversely tight the panel 14 in the longitudinal receiving groove 28.

Figure 5:
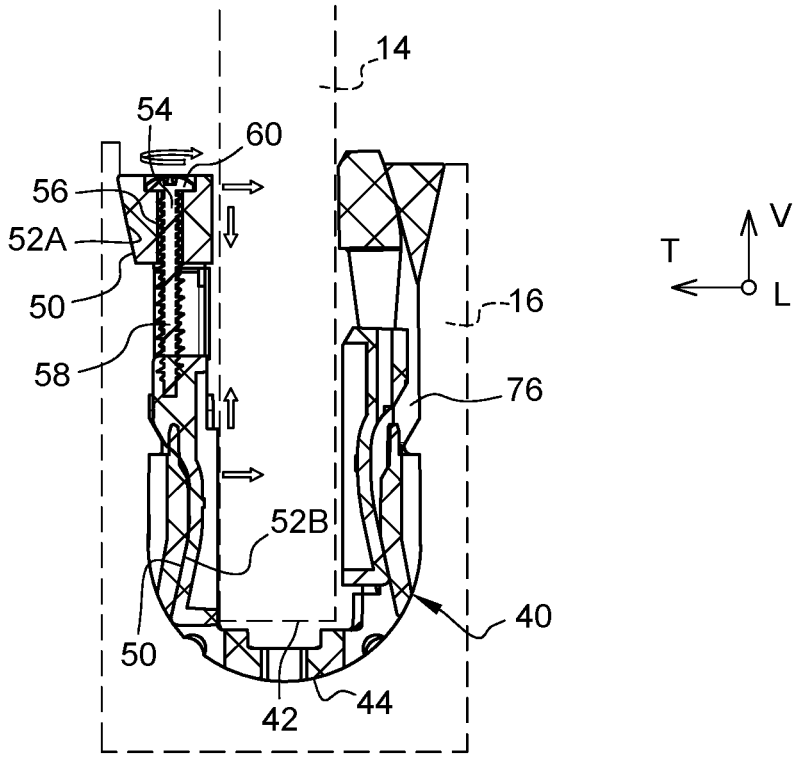
FIG. 5 is a cross-sectional view along the sectional plane 5-5 of FIG. 3 showing the inner wedges of the securing device as they are tightened.
Figure 6:
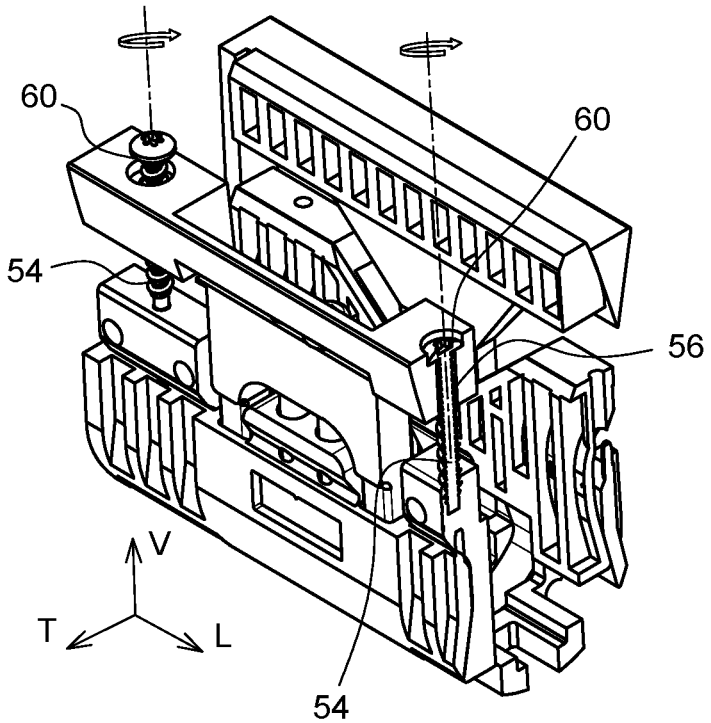
FIG. 6 is a perspective view with a cross-section showing the securing device of FIG. 5.
Figure 7:
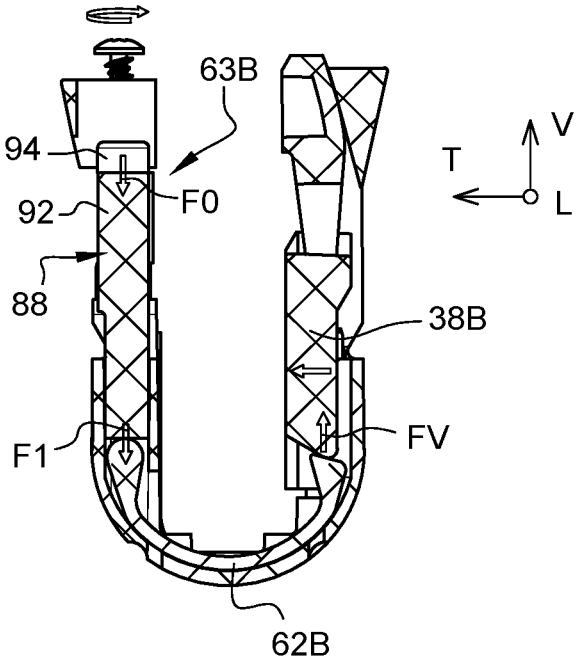
FIG. 7 is a cross-sectional view along the sectional plane 7-7 of FIG. 3 which shows the device for controlling the tightening of the lower outer wedge during its tightening.
Figure 8:
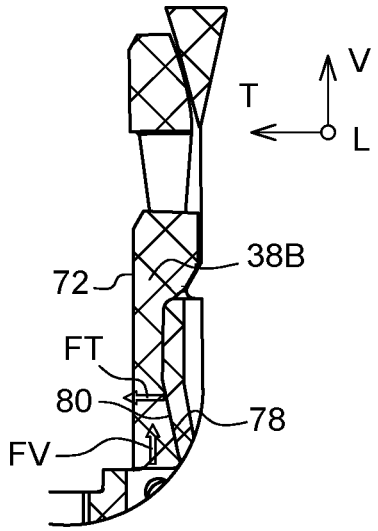
FIG. 8 is a cross-sectional view along sectional plane 8-8 of FIG. 3 showing the lower outer wedge as it slides against a ramp of the cradle.

The securing device 18 also comprises a cradle 40, the profile of which forms a "U". The cradle 40 which is designed to straddle a lower edge 42 of the panel 14, as shown in FIGS. 1 and 5. The cradle 40 has a rounded lower face 44 complementary in shape to that of the bottom 30 of the receiving groove 28. The cradle 40 is received in the groove 28 with sufficient transverse clearance to allow angular movement of the panel 14 about a longitudinal axis by slipping the lower face 44 of the cradle 40 against the bottom 30. This allows the verticality of the panel 14 to be adjusted according to the horizontality of the slab 12 by pivoting the cradle 40. The panel 14 is received in the cradle 40 with a transverse clearance which also allows it to pivot slightly relative to the cradle 40 to adjust its verticality.

Each lateral face 32, 34 of the groove 28 also comprises a projecting stop 46 which is intended to retain the cradle 40 vertically at the bottom of the groove 28 by cooperation with a notch 48 made in an external vertical face of the cradle 40.

The cradle 40 is here made of rigid plastic material.

At least one inner wedge 36A or 36B of the securing device 18 is interposed between the inner face 32 of the groove 28 and the inner face 20 of the panel 14, as illustrated in FIG. 5. The inner wedge 36A or 36B has at least one inclined face 50 which is intended to cooperate with a ramp 52 which has a fixed vertical position to enable it to be tight by vertical sliding. In the examples shown in the figures, the ramp 52 is integral with either the support rail 16, as shown at the top of FIG. 5, or the cradle 40, as shown at the bottom of FIG. 5.

In the embodiments shown in the figures, the securing device 18 comprises several inner wedges 36A, 36B. It thus comprises, in a non-limiting manner, an upper inner wedge 36A and two lower inner wedges 36B.

The upper inner wedge 36A cooperates with a ramp 52A which is formed in the upper part of the first face 24 of the groove 20. The ramp 52A is designed so that tightening of the upper inner wedge 36A between the panel 14 and the inner face 32 of the groove 28 occurs as it slides downwards. The upper inner wedge 36A here has a tightening face which is intended to be tight either directly against the panel 14 or with the interposition of a shim.

The lower inner wedges 36B each cooperate with an associated ramp 52B of the cradle 40 which bears transversely against the inner face 32 of the groove 28. More particularly, the lower inner wedges 36B are interposed between the ramp 52B and the inner face 20 the panel 14. The ramp 52B is designed so that tightening of the lower inner wedge 36B between the panel 14 and the inner face 32 of the groove 28 occurs as it slides upwards. Each lower inner wedge 36B here has a tightening face which is intended to be tight either directly against the panel 14 or with the interposition of a shim.

The sliding of the upper inner wedge 36A and that of each lower inner wedge 36B is achieved by means of two vertical axis control screws 54. Each control screw 54 is received in an associated smooth orifice 56 in the upper inner wedge 36A in line with each lower inner wedge 36B. The lower end of each control screw 56 is screwed into an orifice 58 in each lower inner wedge 36B. The control screw 54 is, for example, screwed into the orifice 58 with force. Alternatively, the orifice 58 is threaded. In any case, the control screw 54 is engaged with the associated lower inner wedge 36B.

Thus, when the screws 54 are screwed in, the lower inner wedges 36B, locked against rotation by the cradle 40 and the panel 14, slide upwards to a tight position in which they are trapped between the ramp 52B and the panel 14. As the screwing continues, a head 60 of the control screw 54 engages the upper inner wedge 36A to slide it downwards until it is wedged between the inner face 32 of the groove 28 and the panel 14. The screwing can be continued until the inner wedges 36A, 36B are tightened with the desired vertical force to achieve vertical securing of the panel 14. In addition to the speed of securing, this system of adjusting the position of the upper inner wedge 36A and each lower inner wedge 36B with a single control screw 54 allows the tightening force applied by each inner wedge 36A, 36B against the panel 14 to be balanced.

The outer wedges 38A, 38B comprise at least one upper outer wedge 38A and at least one lower outer wedge 38B. The upper outer wedge 38A is thus arranged above the outer wedge 38B in the groove 28. Each outer wedge 38A, 38B is interposed between the outer lateral face 34 of the groove 28 and the outer face 22 of the panel 14. Each outer wedge 38A, 38B is vertically slidably mounted between a released position and a tight position between the outer lateral face 34 of the groove 28 and the outer face 22 of the panel 14. The outer wedges 38A, 38B are slidably mounted between their released position and their tight position independently of each other.

It is provided that the tightening of the outer wedges 38A, 38B can be adjusted from the inner side 24 of the panel 14. For this purpose, the securing device 18 comprises at least two movable force transmission members 62A, 62B which are interposed between the lower edge 42 of the panel 14 and the lower bottom 30 of the groove 28. The force transmission members 62A, 62B are each capable of transmitting a sliding force to an associated outer wedge 38A, 38B from the inner side 24.

According to the teachings of the invention, both the upper outer wedge 38A and the lower outer wedge 38B slide vertically upwards from their lower released position to their upper tight position which is located above their released position. Thus, in order to control the outer wedges 38A, 38B to their upper tight position, the movable transmission members 62A, 62B are biased in compression by at least one control device 63 which is arranged on the inner side 24 of the panel 14.

In the example embodiments shown in the figures, each movable transmission member 62A, 62B is formed by a rigid element having the shape of a semi-circular segment which is slidably received in a channel 64A, 64B of complementary shape arranged between the lower edge 42 of the panel 14 and the lower bottom 30 of the groove 28. All the transmission members 62A, 62B have a semi-circular shape with the same radius of curvature.

Each transmission member 62A, 62B thus has an inner transverse end 66 and an outer transverse end 68. The two ends 66, 68 both have a vertically upward facing face.

The transmission members 62A, 62B are mounted in parallel with each other. Each channel 64A, 64B is formed in a bottom of the cradle 40 for receiving the edge 42 of the panel 14. Thus, each transmission member 62A, 62B is received slipping on the bottom of the cradle 40, under the panel 14, and not against the bottom 30 of the groove 28.

The outer end 68 of each transmission member 62A, 62B is intended to be pressed vertically against a thrust face 70A, 70B of the associated outer wedge 38A, 38B, while the inner end 66 is intended to be biased by a substantially vertical force provided by an associated control device 63, as will be explained in more detail below.

The outer ends 68 of the transmission members 62A, 62B are arranged at substantially the same height due to the semi-circular shape of the transmission members. In this regard, the thrust faces 70A, 70B of the outer wedges 38A, 38B are here arranged at the same height. Thus, the upper outer wedge 38A has a tab which extends vertically downwards into a passageway provided in the lower outer wedge 38B to the associated transmission member 62A.

Alternatively, a vertically slidable thrust element is sandwiched between the outer face 68 of the transmission member 62A and the upper outer wedge 38A.

As a non-limiting example, and as shown in the figures, a single transmission member 62A controls the sliding of the upper outer wedge 38A while the lower outer wedge 38B is controlled in sliding by two transmission members 62B. The transmission member 62A associated with the upper outer wedge 38A is here arranged between the two transmission members 62B associated with the lower outer wedge 38B.

At least one of the outer wedges 38A, 38B may move transversely towards the panel 14 as it slides vertically towards its tight position. In this case, the outer wedge 38A, 38B has a longitudinal tightening face 72 which faces towards the panel 14 as illustrated for the two outer wedges shown in the embodiment of FIGS. 1 to 13.

Figure 16:
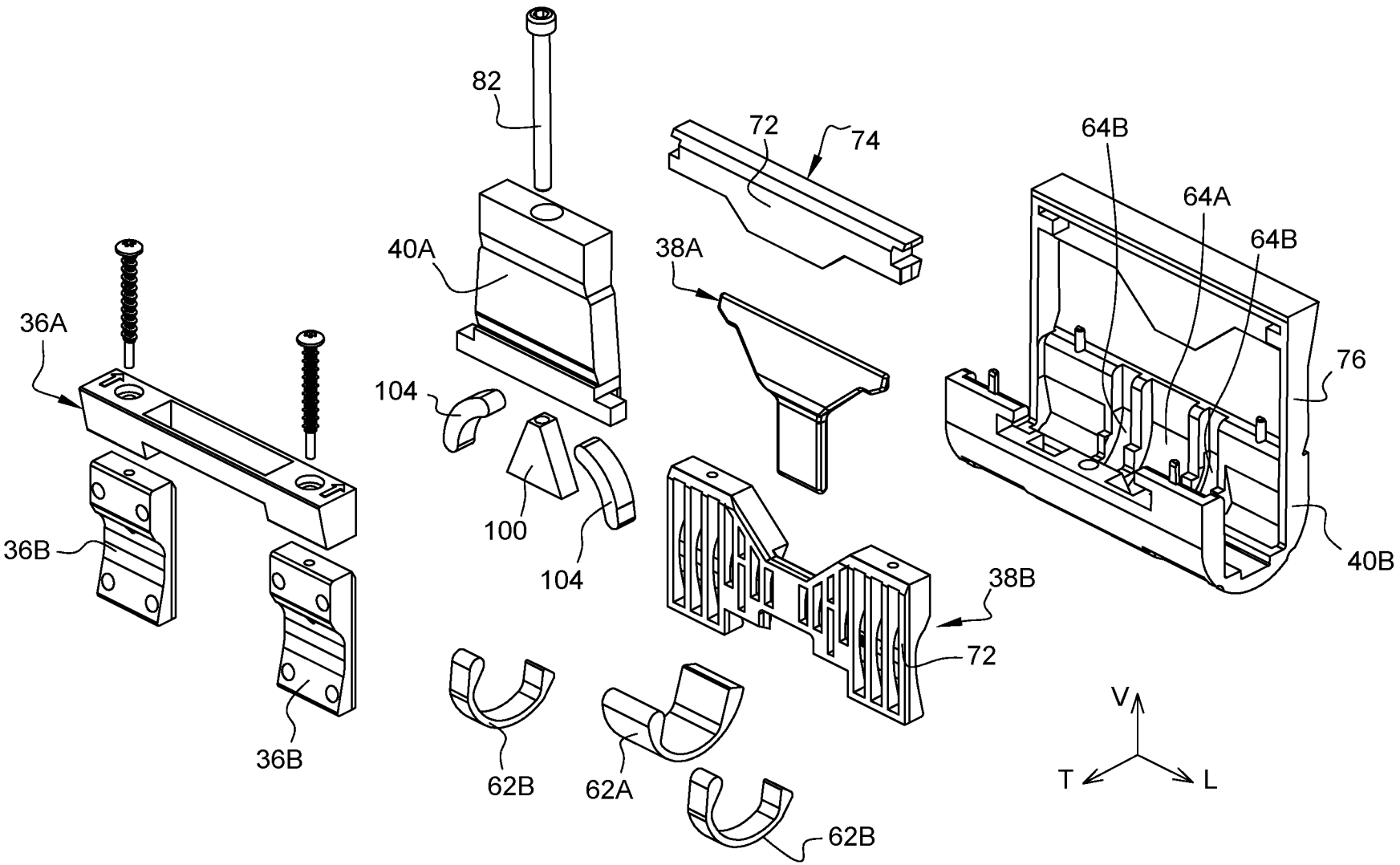
FIG. 16 is an exploded perspective view showing the components of the securing device of FIG. 15.
Figure 17:
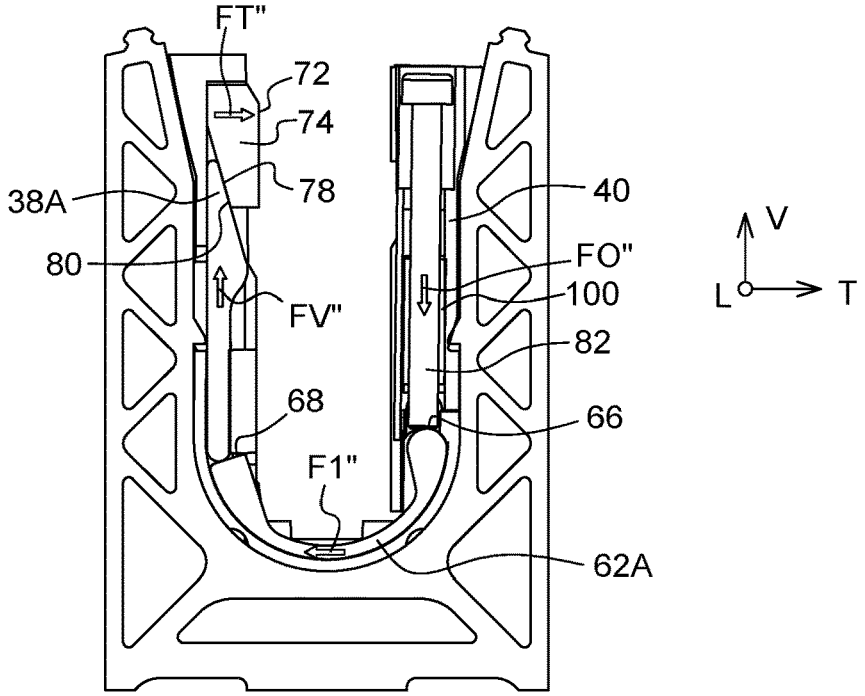
FIG. 17 is a cross-sectional view along the sectional plane 17-17 of FIG. 15 which shows the control device acting on the upper outer wedge.

Alternatively, shown in FIGS. 16 and 17, at least one outer wedge 38A moves only vertically as it slides to its tightening position. In this case, at least one tightening pad 74 separate from the associated outer wedge 38A is interposed between said outer wedge 38A and the outer face 22 of the panel 14. In this case, the tightening face 72 is carried by the tightening pad 74. The tightening pad 74 is transversely slidably received in the cradle 40 between a released position in which its tightening face 72 is spaced from the panel 14, and a tight position in which its tightening face 72 is pushed against the panel 14 by the associated outer wedge 38A, 38B in the tight position. This embodiment is equally applicable to the various embodiments described below.

Regardless of the embodiment of the outer wedge, the tightening face 72 can be tight either directly in contact with the outer face 22 of the panel 14, or with the interposition of a shim between the tightening face 72 and the outer face 22 of the panel 14. This shim allows the same securing device 18 to be adapted to different thicknesses of panels 14. The thickness of the tightening shim will thus be adapted to the thickness of the panel 14 to be secured.

In the embodiments shown in the figures, each outer wedge 38A, 38B is interposed between an outer flange 76 of the cradle 40 and the outer face 22 of the panel 14. The outer flange 76 of the cradle 40 is arranged against the outer face 34 of the groove 28 and extends in a vertical longitudinal plane to adjacent the opening of the groove 28.

To enable transverse tightening of the panel 14 as they slide vertically upwards, at least one of the outer wedge 38A, 38B or the internal face of the outer flange 76 of the cradle 40 has a tightening ramp which pushes the tightening face 72 transversely towards the panel 14 as the associated outer wedge 38A, 38B slides towards its tight position.

In the examples shown in FIGS. 7 to 13, when the outer wedge 38A, 38B includes the tightening face 72, it includes a ramp 78 which cooperates by slipping with a complementary ramp 80 formed in the outer flange 76 of the cradle 40. In this case, the outer wedge 38A, 38B moves both vertically and transversely towards the panel 14 as it moves to its tight position.

Alternatively, as shown in FIG. 17, when the outer wedge 38A, here upper, is separate from the pad 74 comprising the tightening face 72, the outer wedge 38A comprises a ramp 78 which cooperates by slipping with a complementary ramp 80 carried by the tightening pad 74. In this case, the outer wedge 38A can move purely vertically with respect to the cradle 40.

According to a first embodiment of the invention which is shown in FIGS. 1 to 12, the arrangement comprises two separate control devices 63A, 63B for independently controlling the sliding of each outer wedge.

Each control device 63A, 63B comprises here at least one screw 82A, 82B which is capable of biasing at least one transmission member 62A, 62B. Each screw 82A, 82B is screwed into an internal threaded 84A, 84B which is fixed with respect to the cradle 40 to allow axial displacement of the screw 82A, 82B with respect to the cradle 40 by screwing or unscrewing. In the example shown in FIG. 4, the internal thread 84A, 84B is formed in a nut 86 which is securely mounted in the cradle 40 on the inner side of the panel 14.

Figure 9:
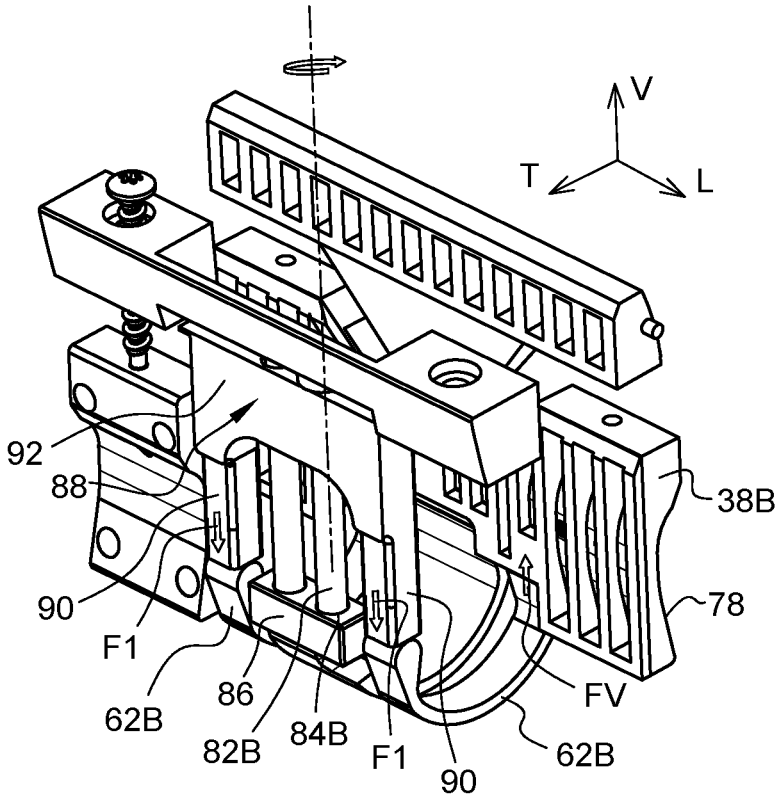
FIG. 9 is a perspective view with a cross-section along sectional plane 8-8 in which the cradle has not been shown to allow a better view of the lower outer wedge tightening control device.
Figure 10:
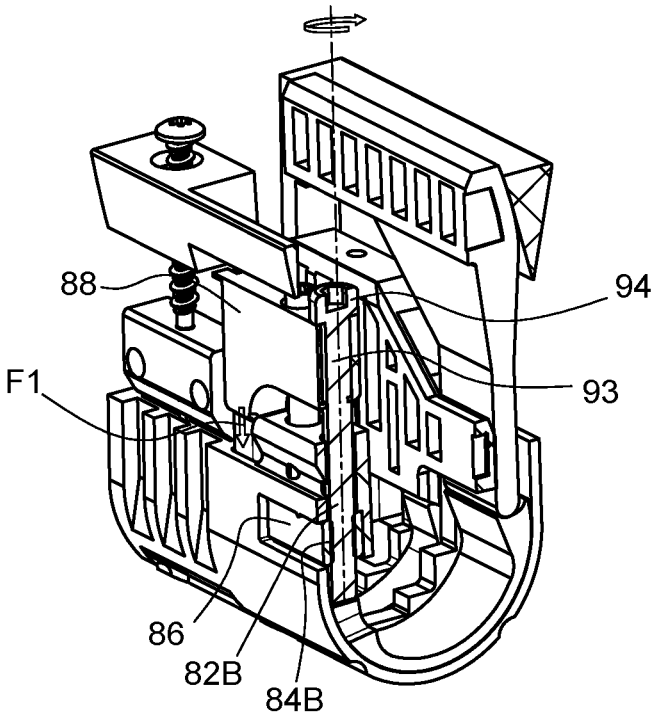
FIG. 10 is a perspective view with cross-section along the sectional plane 7-7.

As shown in detail in FIGS. 4, and 7 to 10, the control device 63B associated with the lower outer wedge 38B thus comprises a first control screw 82B of substantially vertical axis, a lower end threaded portion of which is received in an associated fixed internal thread 84B. The control device 63B also includes a jumper 88 which allows the two transmission members 62B associated with the lower outer wedge 38B to be controlled simultaneously by means of a single control screw 82B. The jumper 88 comprises two lower vertical legs 90 which extend from both longitudinal ends of an upper body 92. The jumper 88 bridges the transmission member 62A associated with the upper outer wedge 38A which is located between the two transmission members 62B associated with the lower outer wedge 38B, as seen in FIG. 9. The jumper 88 is guided in a vertically sliding manner in the cradle 40, each of its two legs 90 being arranged in line with the inner ends 66 of the associated transmission members 62B. The internal thread 84B is arranged between the two legs 90. The body 92 of the jumper is pierced by a smooth orifice 93 in which the stem of the control screw 82B is received in a freely sliding manner, as shown in FIG. 10. The control screw 82B has a head 94 which is intended to abut against an upper face of the body 92 when screwed in to push the jumper 88 downwards, as indicated by the arrows "F0" in FIGS. 7 to 10, so that the two legs 90 each bias the associated transmission member 62B, as illustrated by the arrows "F1" in FIGS. 7 and 9. The transmission members 62B thus slide so that their outer end 68 pushes the lower outer wedge 38B upwards towards its tight position, as shown by arrows "FV" in FIGS. 7 to 10. The ramp 78 of the lower outer wedge 38B then slips against the ramp 80 to push its tightening face 72 transversely against the panel 14 as indicated by arrow "FT" in FIG. 8.

The length of the control screw 82B is determined so as not to bias the transmission member 62A associated with the upper outer wedge 38A when the lower outer wedge 38B is in its tight position, as shown in FIG. 9.

Referring now to FIGS. 4 and 10 to 13, a second control device 63A is associated with the upper outer wedge 38A. It comprises a second control screw 82A of substantially vertical axis which is freely slidably received in a smooth orifice 96 in the body 92 of the jumper 88. A threaded section of the control screw 82A is screwed into a second internal thread 84A which is fixed with respect to the cradle 40 and which is arranged in line with the inner end 66 of the transmission member 62A associated with the upper outer wedge 38A. The control screw 82A is here a grub screw which can thus be screwed in without pressing on the body 92 of the jumper. The control screw 82A has a recess at its upper end 98 which allows it to be screwed in by means of a tool (not shown) fitted with a suitable bit.

Figure 11:
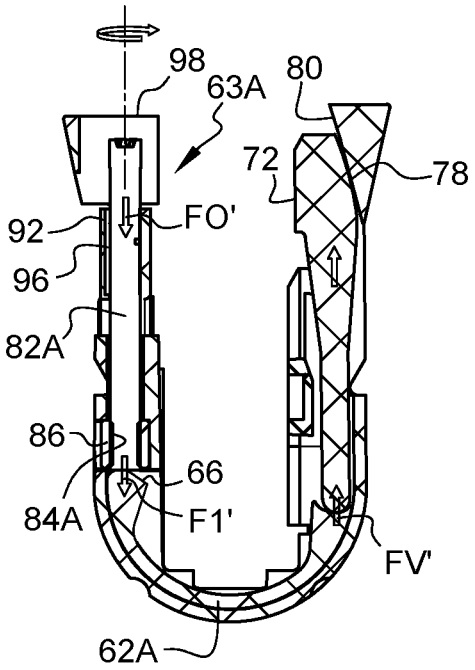
FIG. 11 is a cross-sectional view along the sectional plane 11-11 of FIG. 3 which shows the upper outer wedge in a released position.
Figure 12:
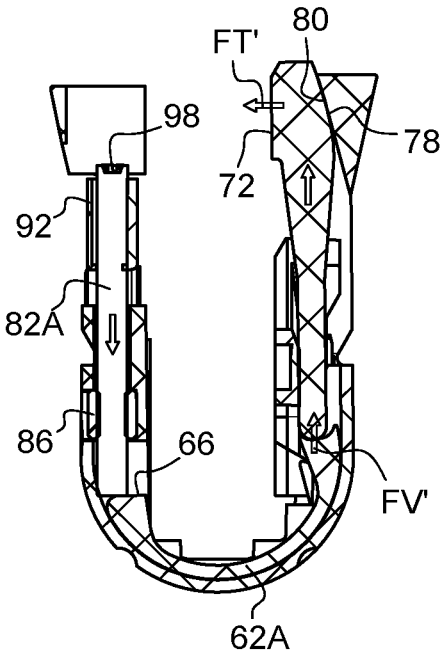
FIG. 12 is a similar view to FIG. 11 showing the upper outer wedge in a tight position.
Figure 13:
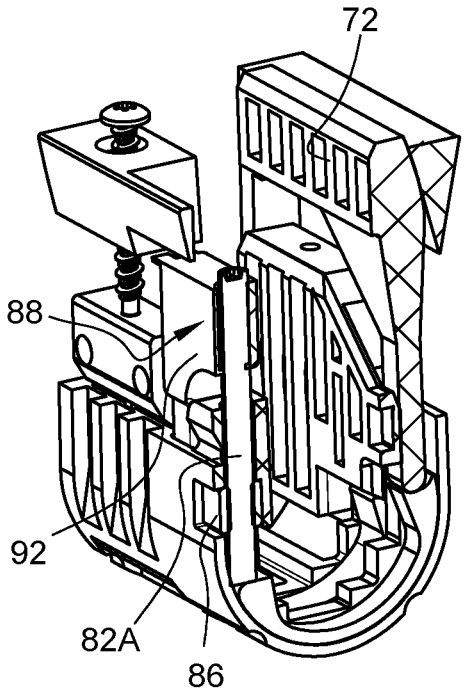
FIG. 13 is a perspective view with a section along the sectional plane 11-11.

The length of the control screw 82A is sufficient for a lower end of the control screw 82A to bias the inner end 66 of the transmission member 62A as it is screwed in, while its recess remains accessible to a tightening tool, as shown in FIG. 11.

When securing the panel 14, the control screw 82A is screwed into the nut 86, causing it to be lowered, as indicated by the arrow "F0'" in FIG. 10. Its lower end then pushes down against the inner face 66 of the transmission member 62A, as indicated by arrow "F1'" in FIG. 10. This causes the transmission member 62A to slide with its outer end 68 pushing the upper outer wedge 38A upwards from its released position, shown in FIG. 10, to its tight position, shown in FIG. 11. The transmission member 62A thus transmits an upwardly directed sliding force "FV'". As it slides upwards, the ramp 78 of the upper outer wedge 38A slips against the ramp 80 of the cradle 40 to push the tightening face 72 transversely against the panel 14 with a force "FT'", as shown in FIG. 11.

Figure 14:
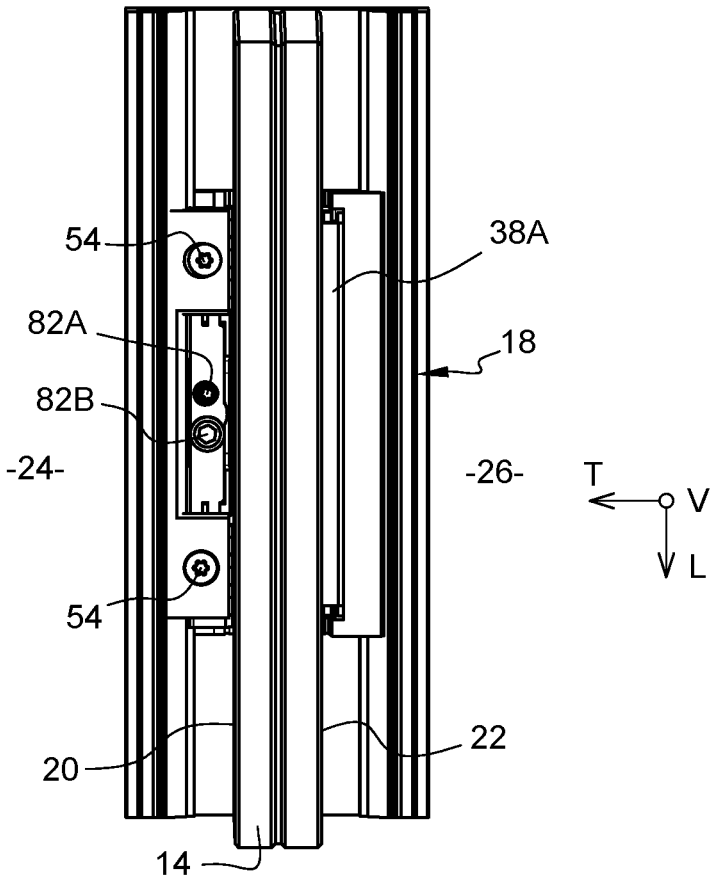
FIG. 14 is a top view of FIG. 1.
Figure 15:
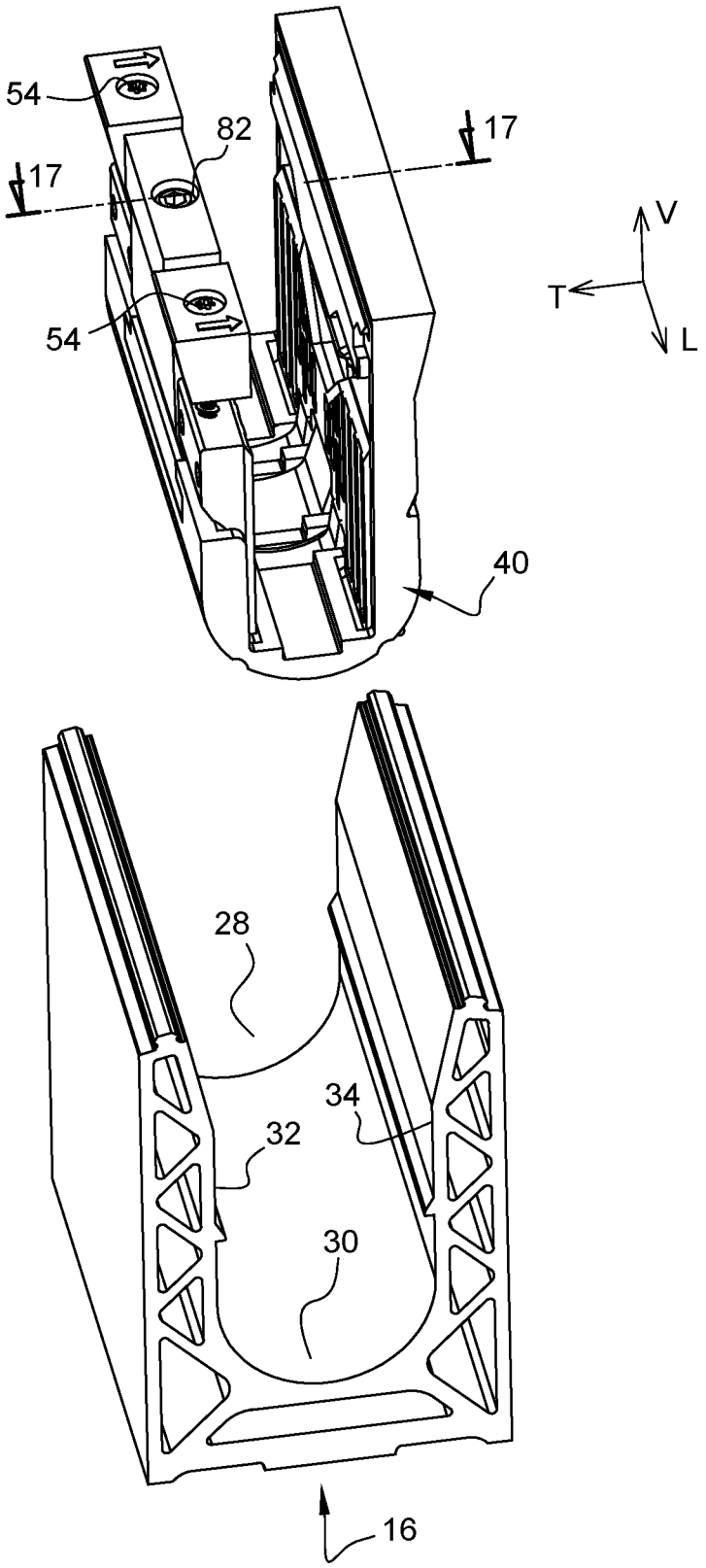
FIG. 15 is an exploded perspective view showing a rail and a panel securing device made according to a second embodiment of the invention.

As shown in FIG. 14, the two control screws 82A, 82B are located on the inner side 24 of the panel 14 to allow tightening of the outer wedges 38A, 38B from the inner side 24.

According to a second embodiment of the invention which is shown in FIGS. 15 to 19, the securing device 18 comprises a control device 63 common to the two outer wedges 38A, 38B to allow simultaneous tightening of the two outer wedges 38A, 38B in a manner similar to what has been described for the inner wedges 36A, 36B. In particular, this control device 63 allows the tightening forces of the lower and upper outer wedges 38A, 38B to be automatically balanced. Of course, as in the first embodiment, the control screw 82 is located on the inner side of the panel.

The control device 63 comprises at least one control screw 82 with a vertical axis which is screwed into a nut 100 which is vertically slidably mounted on the inner side of the cradle 40. The cradle 40 is here made in an inner half 40A and an outer half 40B which can be assembled together by transverse interlocking.

The control screw 82 is arranged in line with the inner end 66 of the transmission member 62A associated with the upper outer wedge 38A. Thus, when the control screw 82 is moved downwards, as indicated by the arrow F0" in FIG. 17, its lower end is capable of biasing the inner end 66 of the transmission member 62A associated with the upper outer wedge 38A towards its tight position. The transmission member 62A then slides, as indicated by arrow F1", so that its outer end 68 applies a force FV" to the upper outer wedge 38A. The slipping of the ramp 78 of the upper outer wedge 38A against the ramp 80 of the tightening pad 74 applies a transverse force FT" to tight the pad 74 against the panel 14.

Figure 18:
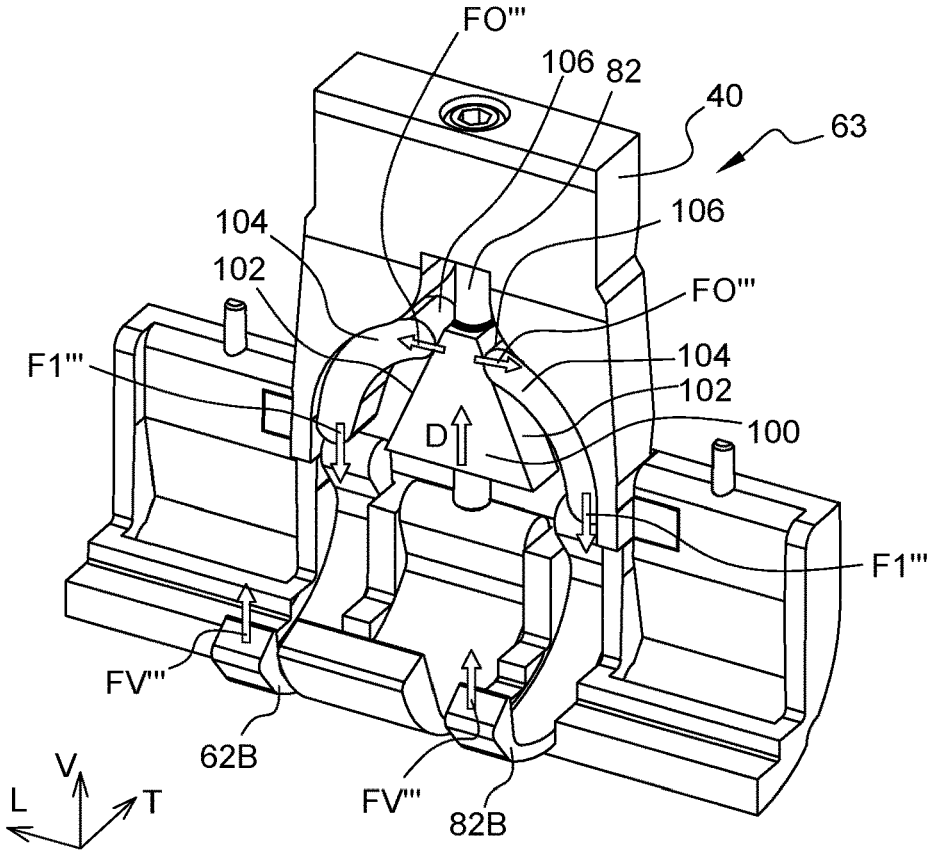
FIG. 18 is a perspective view showing only an inner half of the cradle and the control device for tightening the lower outer wedge.
Figure 19:
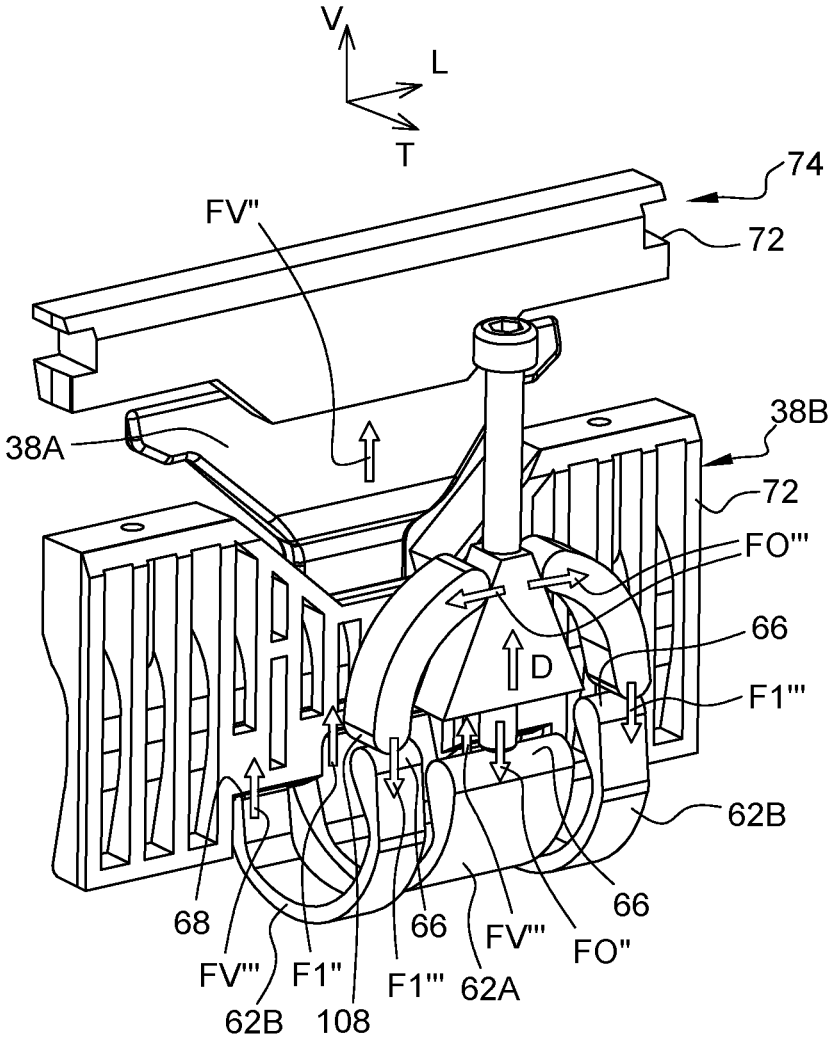
FIG. 19 is a perspective view showing only the outer wedges and the device for controlling their tightening, the cradle not being shown to allow better visualization of the operation of the control device.

In addition, as shown in FIGS. 18 and 19, the nut 100 is capable of cooperating with force return means. Thus, when the nut 100 slides upwards, by screwing in the control screw 82, the transmission members 62B associated with the lower outer wedge 38B are biased towards their tight position by the force return means.

In the example shown in the figures, the force return means are formed by at least one cam 102 slidingly integral with the nut 100 and by at least one pusher 104 guided in displacement along an arcuate path in the cradle 40. The cam 102 is arranged on at least one transverse flank of the nut 100 to move a cam follower 106 of the pusher 104 away from the axis of the control screw 82 when the nut 100 moves upwards with respect to the pusher 104 as indicated by the arrow "D". The cam 104 thus applies a transverse force F0'" to the cam follower 106 of the pusher 104, as shown in FIG. 18.

This causes a lower end 108 of the pusher 104 to slide downwardly to push the inner end 66 of the associated transmission member 62B downwardly, as indicated by arrow F1'". This causes the transmission member 62B to slide with the outer end 68 applying an upwardly directed vertical force FV'" to the lower outer wedge 38B.

As shown in FIG. 16, the pusher 104 is in the form of a segment in an arcuate shape extending over a quarter of a circle, advantageously in a vertical longitudinal plane in order to take up as little space as possible. A concave border of the pusher 104 faces in the direction of the axis of the control screw 82. The upper end of the pusher 104 faces longitudinally towards the control screw 82 to form the cam follower 106, while its lower end 108 is arranged in contact with the inner end 66 of one of the transmission members 62B associated with the lower outer wedge 38B.

Given that the cam 102 is capable of applying a radial reaction force to the control screw 82, the control device 63 advantageously comprises two opposite cams 102 arranged on two opposite flanks of the nut 100. Two pushers 104 as described above are arranged symmetrically with respect to a transverse plane passing through the axis of the control screw 82 in order to cooperate each with one of the cams 102. Each pusher 104 thus enables an associated transmission member 62B to be driven. This advantageously enables the reaction forces applied radially to the control screw 82 to be balanced.

The control screw 82 is mounted to slide freely with respect to the cradle 40. This allows simultaneous and balanced tightening of the two outer wedges 38A, 38B by means of the single control screw 82.

When the outer wedges 38A, 38B are tightened, the control screw 82 is screwed into the nut 100. This causes a vertical gap between the nut 100 and the lower end of the control screw 82.

Thus, the lower end of the control screw 82 applies a downwardly directed vertical force F0" to the inner end 66 of the transmission member 38A which tends to push the upper outer wedge 38A upwards. The slipping of the ramp 78 of the upper outer wedge 38A against the ramp 80 of the tightening pad 74 causes the tightening pad 74 to move until its tightening face 72 is tightened against the panel 14.

In reaction, the nut 100 moves upwards. The nut 100 then applies an upward force to the cams 102, which tends to simultaneously move the pushers 104 away from the axis of the control screw 82. The lower ends 108 of the pushers 104 abut the inner ends 66 of the associated transmission members 62B which slide to bias the lower outer wedge 38B towards its tight position. The ramp 72 of the lower outer wedge 38B then slips against the ramp 80 of the cradle to move the tightening face 72 transversely towards the panel 14.

As the control screw 82 continues to be screwed, the lower and upper outer wedges 38A, 38B are simultaneously tightened so that the forces applied by the nut 100 on the one hand and the control screw 82 on the other hand are balanced. The two outer wedges 38A, 38B are thus tightened in substantially the same manner and the force applied by the tightening faces 72 against the panel 14 are substantially balanced.

Whichever embodiment is selected, when securing the panel, the securing devices 18 are inserted into the groove 28 of the rail 16 with their inner and outer wedges in a released position. The panel 14 is then positioned in the groove so that its edge 42 rests on the cradles 40. Next, the panel 14 is held in the desired vertical position, and then the control screws of each of the inner and outer wedges are screwed in one after the other until each wedge occupies a tight position allowing the panel 14 to be secured in its vertical position. When the two outer wedges 38A, 38B are in the tight position, they are held in that position by the control screw 82, each transmission member 62A, 62B being compressed between the associated outer wedge 38A, 38B and the associated control screw 82.

The invention thus advantageously allows the two outer wedges 38A, 38B to be controlled in their tight position from the inner side 24 of the panel 14.

In addition, the use of transmission members operating in compression to hold the associated outer wedge in the tight position ensures a solid and durable hold over time, without risk of material creep. In addition, the transmission members can be made of materials that are less expensive than rigid plastic materials that are resistant to compression.

The invention claimed is:

1. An arrangement for securing a vertical panel in a longitudinal groove opened vertically upwards for receiving a lower edge of the panel, the panel comprising an inner face and an outer face, the securing being carried out by transverse tightening between transversely opposed wedges, the arrangement comprising:

at least one first upper outer wedge and at least one second lower outer wedge which are each interposed between a vertical outer face of the groove and the vertical outer face of the panel, each of the outer wedges being mounted so as to slide vertically in the groove between a released position and a tight position between the outer face of the groove and the outer face of the panel;

at least two movable transmission members which are interposed between the edge of the panel and a bottom of the groove and which are each adapted to transmit a sliding force to an associated outer wedge applied from an inner side of the panel;

wherein the upper and lower outer wedges slide vertically upwards from their one released position to their tight position located above the released position.

2. The arrangement according to claim 1, wherein, for controlling the outer wedges towards their tight position, all movable transmission members are biased in compression by at least one control device which is arranged on the inner side of the panel.

3. The arrangement according to claim 2, wherein each movable transmission member is formed by at least one rigid element in the form of a semicircular segment which is slidably received in a channel of complementary shape arranged between the edge of the panel and the bottom of the groove.

4. The arrangement according to claim 3, wherein the transmission members are mounted parallel to each other.

5. The arrangement according to claim 3, wherein the channel is formed in a cradle which straddles the edge of the panel and which is interposed between the panel and the bottom) of the groove.

6. The arrangement according to claim 5, wherein each outer wedge is interposed between an outer flange of the cradle and the outer face of the panel.

7. The arrangement according to claim 5, wherein the at least one control device comprises two separate control devices for independently controlling the sliding of the upper outer wedge and the lower outer wedge.

8. The arrangement according to claim 7, wherein each control device comprises at least one screw which is capable of biasing each transmission member, the control screw being screwed into a nut which is mounted in a fixed manner with respect to the cradle in order to allow the axial displacement of the control screw relative to the cradle by screwing or unscrewing, each control device controlling the tightening of each of the upper and lower outer wedges independently of each other.

9. The arrangement according to claim 5, wherein the at least one control device is common to the two upper and lower outer wedges to allow their simultaneous tightening.

10. The arrangement according to claim 9, wherein the control device comprises at least one control screw which is screwed into a nut which is mounted so as to slide vertically in the cradle, the downward sliding of the control screw biasing the transmission member associated with one of the outer wedges towards its tight position, while the upward sliding of the nut biases the transmission member associated with the other of the outer wedges towards its tight position by means of force return means, the tightening of the outer wedges thus being achieved simultaneously by screwing the control screw into the nut.

11. The arrangement according to claim 7, wherein the force return means are formed by at least one cam slidingly integral with the nut and by at least one pusher guided in displacement along an arcuate path in the cradle, the cam being capable of moving a cam follower of the pusher away from the axis of the control screw by causing a lower end of the pusher to slide downwards in order to push the associated transmission member.

12. The arrangement according to the preceding claim 11, wherein the control device comprises two cams and two pushers arranged symmetrically with respect to the axis of the control screw.

13. The arrangement according to claim 1, wherein at least one of the outer wedges moves transversely towards the panel as it slides towards its tight position, said outer wedge comprising a tightening face which is turned towards the outer face of the panel.

14. The arrangement according to claim 13, wherein a shim is interposed between the outer face of the panel and the tightening face.

15. The arrangement according to claim 1, wherein at least one of the outer wedges moves only vertically when sliding into its tight position, at least one transversely slidably mounted tightening pad being interposed between at least one of the outer wedges and the outer face of the panel, the tightening pad comprising a tightening face facing the outer face of the panel.

16. The arrangement according to claim 15, wherein a shim is interposed between the outer face of the panel and the tightening face.

* * * * *